US006021793A

United States Patent [19]

Moulder

[11] Patent Number: 6,021,793

[45] Date of Patent: Feb. 8, 2000

[54] TANK CAR CLEANING AND RINSING APPARATUS AND METHOD

[76] Inventor: Jeffrey Ernest Moulder, Rte. 7 Box 1964, New Caney, Tex. 77357

[21] Appl. No.: 09/028,145

[22] Filed: Feb. 23, 1998

Related U.S. Application Data

[63] Continuation-in-part of application No. 08/686,185, Aug. 1, 1996, Pat. No. 5,720,310.

[51] Int. Cl.[7] ..... B08B 3/00

[52] U.S. Cl. ..... 134/167 R; 134/168 R; 134/173; 134/198

[58] Field of Search ..... 134/167 R, 168 R, 134/169 R, 198, 173, 172; 239/227

[56] References Cited

U.S. PATENT DOCUMENTS

| | | | |
|---|---|---|---|
| 3,874,594 | 4/1975 | Hatley | 239/227 |
| 3,895,756 | 7/1975 | Jaeger | 239/227 |
| 4,716,917 | 1/1988 | Schmidt | 134/167 R |
| 5,352,298 | 10/1994 | Moulder | 134/22.18 |
| 5,392,798 | 2/1995 | Hirose et al. | 134/167 R |
| 5,518,553 | 5/1996 | Moulder | 134/22.18 |

*Primary Examiner*—Randy Gulakowski
*Assistant Examiner*—Paul J. Lee
*Attorney, Agent, or Firm*—Harrison & Egbert

[57] ABSTRACT

A method and apparatus for cleaning and rinsing the interior surfaces of a railway tank car with a single, high-pressure fluid spray. The apparatus is inserted into a tank car through its manway and secured using a lockdown assembly. The swivel assembly includes a swivel shaft which is disposed longitudinally through a swivel housing and is interconnected with a rotor motor and with a hollow spindle assembly. A fluid channel communicates the fluid to the spindle assembly where the fluid is sprayed through a single nozzle onto the interior surfaces of a tank car. Control of fluid spray orbit is accomplished by two perpendicular axes for causing rotation and actuation of the nozzle affixed to the spindle assembly, through the cooperation of an idler gear. Another embodiment provides a streamlined design in which actuation of a hose linkage controlling articulation and bending of a flexible hose means to direct pressurized fluid against the various interior tank car surfaces, is achieved by the rotation of a swivel nut about a corresponding externally-threaded support column means.

14 Claims, 7 Drawing Sheets

TANK CAR CLEANING AND RINSING APPARATUS AND METHOD

RELATED APPLICATIONS

This application is a continuation-in-part of U.S. application Ser. No. 08/686,185 filed on Aug. 1, 1996 now U.S. Pat. No. 5,720,310.

BACKGROUND OF THE INVENTION

This invention relates to cleaning methods and apparatus, and more particularly relates to methods and means for cleaning and rinsing the interior surfaces of railway tank cars and the like.

It is well known in the prior art that a diversity of commodities are transported by land in railway tank cars, truck trailers, transport tankers, etc. Railway tank cars typically are constructed with a single manway entry disposed atop and at the longitudinal center thereof. Prior to being filled or loaded with a particular commodity, such a tank car must be throughly cleaned or rinsed, depending upon the circumstances, for health and safety reasons. Such cleaning and rinsing operations have heretofore been not only labor-intensive and time-consuming, but also hazardous.

It is also well known in the art that there frequently are stubborn deposits contained on the interior surfaces including the bulkheads and floor of tank cars and the like which necessitate the use of a high pressure fluid spray to dislodge such deposits. Typically, to accurately direct such high pressure fluid spray to successfully dislodge deposits and the like, manual intervention is required. As will, of course, be appreciated by those skilled in the art, having a worker enter a tank car through a manway and then spray the various interior surfaces of the tank car under limited maneuverability and lighting conditions subjects the worker to dangers of skin, eye, nose and throat irritation or poisoning attributable to unknown chemicals and contaminants, suffocation from fumes, and physical injury due to slippery surfaces and foreign obstacles and the like, and even from explosions.

There have been several attempts in the art to provide different varieties of robotic means or similar apparatus to improve the methodology for cleaning and washing the interior surfaces of tank cars and the like. For example, Hirose et al. disclose an apparatus for cleaning the inner surface of a tank in U.S. Pat. No. 5,392,798. The Hirose apparatus provides a pair of expansion links with each link having a rotary jet nozzle affixed at the end thereof. Driven by a driving shaft located outside of the tank, the degree of expansion of the pair of links enables the various tank surfaces to receive a jet spray from each of the nozzle pair. Each nozzle head is rotatable about its own axis and is also adaptable to orbit about the axial center of the pipe delivering fluid thereto.

In U.S. Pat. No. 3,895,756, Jaeger teaches a method and apparatus for cleaning vessels that includes a spray nozzle connected to swivel joints mounted on two perpendicular axes. An external mechanism actuates and controls the hydraulically-actuated rotation of the nozzle about the perpendicular axes.

Similarly, Bristol Equipment Company of Yorkville, Ill. provides a nozzle assembly, model TC-N1, which is designed for cleaning foreign and hazardous materials from tank cars. This device affords a longitudinal nozzle sweep of up to 186° and a transverse sweep of up to 70°, with an adjustable nozzle speed of from 15 sec to one hour per sweep. Based upon Bristol Equipment's product brochure, this apparatus incorporates technology from U.S. Pat. Nos. 3,895,756; 4,133,210; 4,147,062; 4,262,533; 4,475,410; 4,479,393; 4,562,747; and Canadian Pat. No. 1,062,041.

It will be appreciated that while these developments in the art have helped minimize the necessity for using manual intervention for cleaning and washing tank cars and the like, several problems still remain. Practitioners in the art are unable to provide a suitably powerful fluid blast that can dislodge the contaminant film and deposits that regularly are found on tank car interior surfaces and the like. Furthermore, these practitioners are generally unable to avail themselves of an apparatus which direct such a powerful fluid spray toward such interior surfaces with an acceptable accuracy and efficiency to avoid wasting water and other fluids, and to avoid an undue accumulation of washer fluid and dislodged a deposits in the bottom of a tank car. Indeed, the elongated configuration of a conventional tank car, not to mention such obstacles as standpipes and valve rods, are particularly difficult to reach and clean.

Significant improvements in the art have been made by the present inventor in U.S. Pat Nos. 5,352,298 and 5,518,553. U.S. Pat No. 5,352,298 teaches an apparatus and method for cleaning and stripping residue, contaminants, debris, etc. from the interior surfaces of tank cars and the like with a X-frame assembly with a pivotally attached swivel support assembly. The swivel support assembly is pivotally attached to a K-frame assembly which includes a plurality of arms interconnected with spray nozzles capable of being directed proximal to every interior surface. U.S. Pat No. 5,518,553 teaches a cleaning apparatus and method configured to reach every interior surface of a substantially vertical storage tank and the like. A fully maneuverable assembly is disclosed that inherently coordinates and synchronizes hydraulically-driven rotation of a vertical pole disposed on the floor of a storage tank with the hydraulically-driven rotation of a spray bar disposed at the remote end of a boom assembly. Close proximity of the spray to the internal surfaces is controlled by hydraulically operated cylinders contained on a rotor assembly.

The multiple nozzle devices known in the art, of course, distribute and diminish the trust obtainable from suitable commercially available pumps among the various nozzles. Using electrically-driven pumps to inject high-pressure cleaning and wash fluid such as water introduces safety hazards that may cause fire or explosion. Hydraulic pumps require cumbersome hoses and are not as compact, portable and versatile as pneumatic pumps. Single nozzle nozzles which are presently available in the art are unable to deliver a sufficiently high-pressure fluid spray against the various interior tank car surfaces to allow for the effective and thorough purging of even stubborn debris and deposits therefrom.

Furthermore, practitioners in the art have heretofore been unable to remotely clean and wash the interior of tank cars and the like with a device that provides a powerful orbital fluid spray that reaches all of the surfaces including end caps and the like which may be as far away from the nozzle as 20 feet In addition, it would be advantageous if there were available in the art a sufficiently portable and self-contained apparatus that could be readily hanged from a common wash-rack hoist and the like.

Accordingly, these limitations and disadvantages of the prior art are overcome with the present invention, and improved means and techniques are provided which are useful for cleaning and washing the interior of tank cars and the like.

SUMMARY OF THE INVENTION

The present invention provides a method and apparatus for cleaning and rinsing the interior surfaces of a railway tank car and the like with a single, powerful fluid spray. An apparatus constructed under the teachings of the present invention is inserted into a tank car through its manway and secured thereto using a novel lockdown assembly. This lockdown assembly enables each of a plurality of lockdown members to be individually secured to the surfaces proximal to the manway lip. Fixedly attached to this lockdown assembly is a hollow support means which is fixedly attached to a swivel assembly. High-pressure fluid enters the swivel assembly through a conduit means which is contained within the support means.

The swivel assembly includes a swivel shaft which is disposed longitudinally through a swivel housing and is interconnected with a rotor motor means at one end thereof and interconnected with a hollow spindle assembly at its other opposite end. Also contained within this swivel assembly is a fluid channel means for communicating the high-pressure fluid passing through the conduit feeder to the spindle assembly where the fluid ultimately is sprayed through a single nozzle onto the interior surfaces of a tank car and the like.

The present invention improves the prior art by affording the ability to direct a high-pressure fluid spray through a precisely controlled orbit to effectively traverse all of the interior surfaces of a tank car even in the presence of obstacles. This unique precision and control of such a fluid spray orbit is accomplished by an apparatus having two perpendicular axes for causing rotation and actuation of the nozzle affixed to the spindle assembly. In particular, an idler gear means which is attached to the swivel shaft and interposed between the swivel housing and the spindle assembly controls the actuation of the nozzle about an actuation axis disposed axially of the spindle means and perpendicularly of the swivel shaft which is, in turn, disposed longitudinally of the swivel housing.

Rotation of the swivel shaft is achieved by a pneumatically-driven rotor motor Actuation of the nozzle means is achieved by a pneumatically-driven actuator motor operating through the action of the idler gear means. Accordingly, in accordance with the present invention, methods and means are provided to clean and wash the interior surfaces of railway tank cars and the like with minimal human intervention and with an efficiency heretofore unknown in the art.

Another embodiment of the present invention comprises a streamlined design in which actuation of a hose linkage controlling articulation and bending of a flexible hose means to direct pressurized fluid against the various interior tank car surfaces, is achieved by the rotation of a swivel nut about a corresponding externally-threaded support column means. Once inserted through a manway of a tank car and securably attached to the manway lip, this embodiment enables the fluid emanating from a nozzle to reach every interior surface by describing 360° orbital paths.

It is an object of the present invention to provide an apparatus for cleaning and rinsing the interior surfaces of tank cars and the like with a powerful fluid spray.

It is another object of the present invention to provide an apparatus for cleaning and rinsing the interior surfaces of tank cars and the like with a powerful fluid spray the orbital pattern of which may be controlled with precision.

It is still another object of the present invention to provide an apparatus for cleaning and rinsing the interior surfaces of tank cars which may be expeditiously and releasably secured to a manway.

It is yet another object of the present invention to provide an apparatus for cleaning and rinsing the interior surfaces of tank cars which may be inserted through and then secured to a manway having uneven contours and other surface irregularities.

It is a feature and advantage of the present invention that it affords a powerful and accurate fluid spray pattern which minimizes human intervention and avoids safety hazards attributable to possible suffocation, chemical poisoning and explosions.

It is another object of the present invention to provide an apparatus for cleaning and rinsing the interior surfaces of tank cars including end caps and the like which may be as far away from the nozzle as 20 feet.

It is still another object of the present invention to provide an apparatus for cleaning and rinsing the interior surfaces of tank cars that is sufficiently portable and self-contained to be readily hanged from a common wash-rack hoist and the like, so that the apparatus may be inserted through and secured to a manway.

It is a specific object of the present invention to provide, in a tank car having a plurality of interior surfaces including a floor, side walls, end walls and a ceiling having a manway for access of a worker thereinto, a rinsing apparatus comprising: a lockdown assembly configured to be releasably and snugly secured to said manway; hollow support means fixedly attached to said lockdown assembly at one end thereof and fixedly attached to a swivel assembly at its other opposite end, and enclosing a fluid conduit means for delivering high-pressure fluid from an external reservoir to said swivel assembly; said swivel assembly configured to be insertable through said manway and contained within a swivel housing fixedly attached to said hollow support means, and having a swivel shaft disposed longitudinally therethrough and interconnected with a rotor motor means at one end thereof and interconnected with a hollow spindle assembly at its other opposite end; said swivel shaft having a plurality of slot means configured for communicating said high-pressure fluid from said fluid conduit means to a fluid channel means contained within said swivel assembly; said spindle assembly having a stationary and a nozzle means fixedly attached to said spindle means for receiving said high-pressure fluid from said channel means and then forming a spray pattern of said high-pressure fluid upon said plurality of interior surfaces of said tank car, and idler gear means rotatably attached to said swivel shaft and interposed between said swivel housing and said spindle assembly for controlling actuation of said nozzle means about an actuation axis disposed axially of said spindle means and perpendicularly of said swivel shaft.

It is another specific object of the present invention to provide a rinsing apparatus having a lockdown assembly comprising: a lip ring configured to be snugly received by a lip surface of said manway; a plurality of independent lockdown members screwably attached at one end thereof to said lip ring and screwably attached at another opposite end thereof to a support ring; and securing means disposed centrally of said lip ring and hingedly attached to a lug means for securing said lip ring to said lip surface of said manway.

It is a still further specific object of the present invention to provide a rinsing apparatus having a lockdown assembly with each of said plurality of lockdown members comprising: cleat means disposed atop said lip ring and affixed to an end of a transversal rod interposed between said lip ring and said support ring, said cleat means configured for rotating said transversal rod; and positioning means disposed atop said support ring and affixed to an end of said transversal rod opposite said end affixed to said cleat means for biasing said lip ring against said lip surface when said positioning means is in a first position and for biasing said lip ring away from said lip surface when said positioning means is in a second position.

It is another specific object of the present invention to provide, in a tank car having a plurality of interior surfaces including a floor, side walls, end walls and a ceiling having a manway for access of a worker thereinto, a rinsing apparatus comprising: a lockdown assembly configured to be releasably and snugly secured to said manway; hollow support column means fixedly attached to said lockdown assembly at one end thereof and pivotally attached to a swivel assembly at its other opposite end, and enclosing a fluid conduit means for delivering high-pressure fluid from an external reservoir to said swivel assembly; said swivel assembly configured to be insertable through said manway and having a swivel body member disposed longitudinally therethrough and interconnected with a rotor motor means at one end thereof and interconnected with a linkage assembly at its other opposite end; fluid conduit means contained within said support column means for communicating said high-pressure fluid from said fluid conduit means to said linkage assembly; said linkage assembly having flexible hose means and nozzle means fixedly attached to said flexible hose means for receiving said high-pressure fluid from said conduit means and then forming a spray pattern of said high-pressure fluid upon said plurality of interior surfaces of said tank car, and actuation means rotatably attached to said support column means for controlling articulation and bending of said flexible hose means about an actuation axis disposed axially of said support column means.

It is yet another specific object of the present invention to provide, in a tank car having a plurality of interior surfaces including a floor, side walls, end walls and a ceiling having a manway for access of a worker thereinto, a rinsing apparatus comprising: a lockdown assembly configured to be releasably and snugly secured to said manway; hollow support column means fixedly attached to said lockdown assembly at one end thereof and pivotally attached to a swivel assembly at its other opposite end, and enclosing a fluid conduit means for delivering high-pressure fluid from an external reservoir to said swivel assembly; said swivel assembly configured to be insertable through said manway and having a swivel body member disposed longitudinally therethrough and interconnected with a rotor motor means at one end thereof and interconnected with a linkage assembly at its other opposite end; said linkage assembly having a first linkage arm fixedly attached to said actuation means and a second linkage arm pivotally attached to said first linkage arm at one end and fixedly attached to said nozzle means at its other opposite end; fluid conduit means contained within said support column means for communicating said high-pressure fluid from said fluid conduit means to said linkage assembly; said linkage assembly having flexible hose means fixedly attached thereto, and having nozzle means fixedly attached to said flexible hose means at a remote end thereof for receiving said high-pressure fluid from said fluid conduit means and then forming a spray pattern of said high-pressure fluid upon said plurality of interior surfaces of said tank car; and actuation means rotatably attached to said support column means for controlling articulation and bending of said flexible hose means about an actuation axis disposed axially of said support column means.

It is still another specific object of the present invention to provide, in a tank car having a plurality of interior surfaces including a floor, side walls, end walls and a ceiling having a manway for access of a worker thereinto, a rinsing apparatus comprising: a lockdown assembly configured to be releasably and snugly secured to said manway; hollow support column means fixedly attached to said lockdown assembly at one end thereof and pivotally attached to a swivel assembly at its other opposite end, and enclosing a fluid conduit means for delivering high-pressure fluid from an external reservoir to said swivel assembly; said swivel assembly configured to be insertable through said manway and having a swivel body member disposed longitudinally therethrough and interconnected with a rotor motor means at one end thereof and interconnected with a linkage assembly at its other opposite end; said linkage assembly having a first linkage arm fixedly attached to said actuation means and a second linkage arm pivotally attached to said first linkage arm at one end and fixedly attached to said nozzle means at its other opposite end; fluid conduit means contained within said support column means for communicating said high-pressure fluid from said fluid conduit means to said linkage assembly; said linkage assembly having flexible hose means fixedly attached thereto, and having nozzle means fixedly attached to said flexible hose means at a remote end thereof for receiving said high-pressure fluid from said fluid conduit means and then forming a spray pattern of said high-pressure fluid upon said plurality of interior surfaces of said tank car, actuation means including an internally-threaded nut means pivotally attached to said linkage assembly and configured to rotatably receive corresponding external threads affixed to said support column means for controlling articulation and bending of said flexible hose means about an actuation axis disposed axially of said support column means; and said linkage assembly further including a pivot point means where said second linkage arm is pivotally attached to a backbone support means of said swivel nut means for articulating and bending said hose means responsive to said actuation means.

These and other objects and features of the present invention will become apparent from the following detailed description, wherein reference is made to the figures in the accompanying drawings.

IN THE DRAWINGS

DETAILED DESCRIPTION

Figure 1:
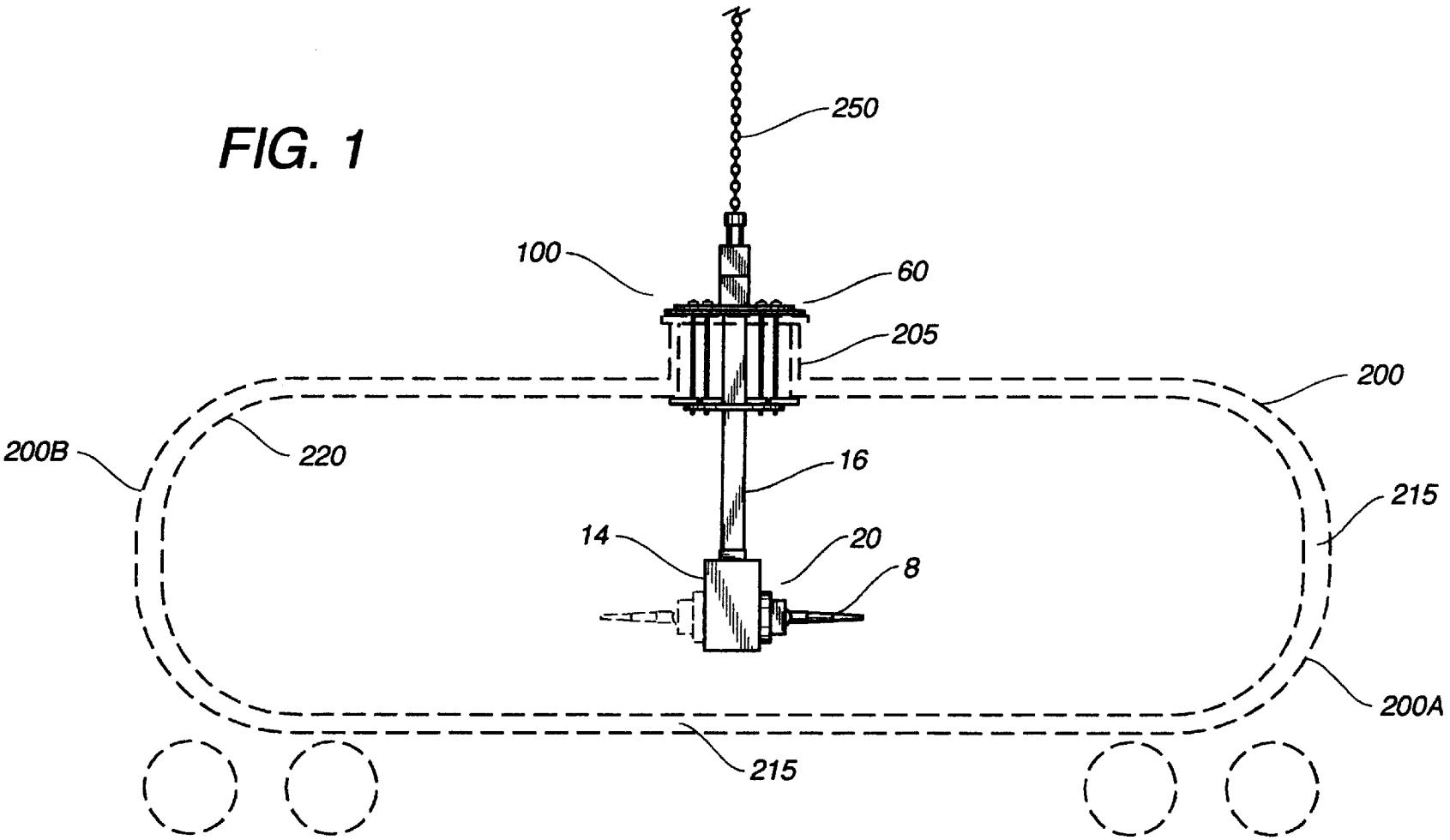
FIG. 1 depicts a front view of the preferred embodiment of the present invention being lowered into a railway tank car.

As shown in FIG. 1, as contemplated by the present invention, rinsing apparatus 100 is configured to be lowered by hoist 250 through manway 205 into tank car 200. Railway tank car 200 is depicted with debris-laden film layer 215 disposed upon interior surfaces 220 thereof. Rinser apparatus 100 is shown secured to manway 205 with lock-down assembly 60 and having swivel assembly 20 with nozzle 8 disposed at an end of hollow swivel housing and fluid conduit 16. While the present invention is shown in FIG. 1 oriented toward end 200A of tank car 200, dotted lines show its orientation toward other opposite end 200B thereof. The preferred methodology for expeditiously changing the orientation of rinser apparatus 100 toward each of opposite ends 200A and B so that debris layer 215 may be cleaned and rinsed from upon all of interior surfaces 220 will be hereinafter described in detail.

Referring now to FIGS. 1–6, it will become evident that the preferred embodiment of the present invention is designed to provide precise control of a single high-pressure, concentrated fluid stream emanating from nozzle 8 for impacting virtually every interior surface 220 of railway tank car 200 and the like. Rinser apparatus 100 comprises swivel assembly 20 which functions in combination with the novel gear-action of idler member 17 to synergistically blast high-pressure fluid F through nozzle means 8 onto interior surfaces 220 of tank car 200. As will become clear to those skilled in the art, fluid F—under pressure as much as 200–300 psi—flows through a conduit 18 contained within hollow support means 16 and into swivel housing 14 and then flows through plurality of preferably elliptical-shaped slots 30 interspersed along swivel shaft 2 contained within housing 14.

Fluid conduit 18 is preferably fixedly interconnected with swivel housing 14 with a flange and the like. Thus, fluid F flows from an external reservoir or the like through conduit 16 and around rotating shaft 2 and enters channel 11 by passing through plurality of slots 30. At the opposite end of fluid channel 11 proximal to spindle 10 there is another plurality of preferably elliptical-shaped slots 35 in spindle 10 through which fluid F enters nozzle 8. In the preferred embodiment, it has been found that having three such slots in each of the swivel assembly and the spindle assembly provides a sufficient flow path for the high-pressure fluid to be effectively sprayed upon the various interior surfaces of a tank car and the like. Nozzle 8 is preferably screwably attached to spindle housing 7. As will be understood by those skilled in the art, spindle 10 remains stationary during the operation of the present invention.

As will be evident to those knowledgeable in the art, seals 15 are required as containment means to contain pressurized fluid F passing through portion of fluid channel 11, which is configured axially of longitudinal axis L of swivel assembly 20 and included swivel housing 14, without inhibiting the free rotation of swivel assembly 20 relative to swivel shaft 2. The seals contemplated under the present invention are preferably constructed from chemically-resistant polymer such as "V-packing" and the like. Thus, as taught by the present invention, fluid F enters swivel assembly 20 under high pressure from conduit 18 and then flows within portion 11A of channel 11 preferably disposed along longitudinal axis L of swivel housing 14 parallel to swivel shaft 2. Next, fluid F changes course by entering portion 11B of fluid channel 11 perpendicularly of longitudinal axis L, then traverses portion 11C of fluid channel 11 which is disposed parallel to fluid channel portion 11A and changes direction again by entering portion 11D of fluid channel 11 perpendicularly of longitudinal axis L and then passes into hollow spindle 10 and, in turn, passes through nozzle 8, thereby impacting rail car interior surfaces and the like in a series of pressurized orbital sprays. Obviously, under the influence of such a high-pressure, concentrated fluid stream, these interior surfaces are readily cleaned and rinsed free of debris and the like which have adhered thereto and accumulated thereon.

As will be understood by those skilled in the art, when actuated through idler gear means 17, nozzle 8 is caused to rotate about actuator axis A which is preferably disposed perpendicularly of rotational or longitudinal axis L. Thus, preferably pneumatically-driven rotor motor 1 causes swivel assembly 20 to rotate about longitudinal axis L as long as appropriate to accomplish necessary cleaning and/or rinsing of interior surfaces 220. According to the present invention, this rotation of swivel assembly 20 occurs without actuating nozzle 8 provided that idler gear 17 rotates simultaneously with swivel assembly 20. When, on the other hand, idler gear 17 ceases rotating in conjunction with swivel assembly 20, nozzle 8 is actuated, thereby directing the stream of pressurized fluid F radially of actuator axis A and emanating from nozzle 8 against proximal interior surfaces of tank car 200. While swivel assembly 20 is independent of idler 17, swivel assembly 20 nevertheless remains enmeshed with actuator drive gear 4. As will be appreciated by those skilled in the art, actuator drive gear 4 is an integral component of swivel assembly 20. Accordingly, when idler 17 stops rotating with swivel assembly 20, then enmeshed gear 4 will rotate along with worm shaft 3 meshed with worm 5, thereby actuating interconnected nozzle 8. Conversely, if idler 17 rotates along with orbiting swivel assembly 20, the enmeshed relationship of gear 4 and idler 17 becomes locked or frozen, wherein no actuation of nozzle 8 occurs.

More particularly, when idler gear 17 stops rotating simultaneously with swivel assembly 20, a path or track is provided for enmeshed actuator drive gear 4 which, in turn, propels gear 4 and adjoined corresponding actuator worm 5. Thus, actuator gear 4 is forced over idler gear 17, thereby being caused to rotate. This causes worm gear 6 to rotate in combination with worm 5, in turn, causes linear actuation of nozzle 8 relative to actuator axis A. In the preferred embodiment, the actuation of nozzle 8 traverses at least 180 degrees. As will be understood by those skilled in the art, actuator worm 5 is enmeshed with corresponding actuator worm gear 6, thereby rotating nozzle 8. Actuator axis A is disposed axially of spindle 10. By controlling the extent of this actuation of nozzle 8 relative to axis A, the direction and path of pressurized fluid emanating therefrom may be minutely changed without in any way interrupting the rotation of swivel assembly 20 about longitudinal axis L, which is configured to be perpendicular to actuator axis A.

Under the present invention, motors 1 and 12 are preferably pneumatically-driven gear motors with air supplied from conventional air cylinders and the like. Depending upon the particular gear ratio, such motors are typically difficult to turn from their respective output shaft ends because of this gear reduction. Hence, when stopped, actuator motor 12 functions as a brake; since actuator motor 12 is enmeshed with idler gear 17, this motor-resistance is greater than the force prerequisite for holding idler 17 in place so that actuator drive gear 4 rotates. On the other hand, motor 12 must only keep pace with motor 1 to neutralize any actuation. As will be understood by those skilled in the art, the rate of actuation may be changed from fast actuation to no actuation by adjusting the disparity between the rotational speed of the rotor motor and the actuator motor.

Accordingly, the present invention generates a series of continuous single and substantially orbital-shaped fluid sprays capable of cleaning and rinsing all of the interior surfaces of a tank car and the like. It should become evident that the present invention contemplates an apparatus which provides continuous transitions of a novel combination of two perpendicular axes which afford minute adjustability of a concentrated high-pressure fluid stream against the various and even partially obscured interior surfaces typically found in a railway tank car and the like. Each of motors 1 and 12 cooperate through the coordination of idler means 17 to cause rotation of longitudinal axis L and actuation axis A, respectively. By forwarding or reversing each rotor and actuator motor, actuation of nozzle 8 occurs in a particular direction commensurate with particular cleaning and rinsing requirements.

As will be described hereinafter, regulating the relative speeds of these motors provides a wide range of orbital movement of the nozzle disposed at the free end of spindle assembly 25. It will be appreciated that the idler member taught by the present invention provides a vehicle for controlling nozzle actuation independently of swivel assembly rotation. Furthermore, it will be seen that since idler member 17 is independent of not only stationary spindle 10, but also rotating swivel 20, idler 17 may be driven forward or reverse directions by preferably pneumatically-driven actuator motor 12. It will be understood, of course, that the forward or reverse action of idler gear 17 caused by actuator motor 12 occurs without interrupting the rotational inertia of swivel assembly 20.

The present invention is powered by air supplied by a conventional air compressor (not shown). Accordingly, in a manner well known in the art, air is supplied to actuator motor 12 and to rotor motor 1. Under the preferred embodiment, the relative directions of rotation and rotational speeds of these two motors determine the pattern of orbital spray that impacts interior surfaces of a tank car and the like. As will be appreciated by those skilled in the art, when this cooperation between the rotational and actuation functions of the present invention is integrated with conventional simple programmable speed control devices, a high-pressure fluid stream may be delivered having an accuracy heretofore unknown in the art. Such pinpoint accuracy is especially useful and, indeed, can be critical for washing buildup particularly on the bottom of tank cars and the like, under circumstances in which large accumulation of debris-laden fluid is likely to occur.

It is contemplated that such programmability include controlling the speed of orbital washes; slowing rotation and simultaneously either reversing or forwarding actuation so that nozzle rotation may be either accelerated or retarded depending upon the particular cleaning and rinsing requirements. Thus, as hereinbefore described, by causing both pneumatic motors 1 and 12 to rotate in a like direction, and at like speeds, no actuation occurs. By causing both motors to rotate in the same direction, but at different speeds, actuation occurs —with the direction of actuation determined by which motor's speed is slower than the other and the concomitant speed of actuation determined by the differential between the motors' relative speeds. If the two motors are rotating in opposite directions, actuation occurs at higher speeds because in addition to actuator gear 4 being forced over idler gear 17, the idler gear is now moving too, but in the opposite direction of swivel assembly 20. Accordingly, actuation occurs at about twice the speed that it would occur if the idler gear were stationary.

Another aspect of programmability contemplated by the present invention is applicable for dealing with the frequent occurrence of heavy accumulation of fluid typically including dirt, grime, debris, etc., on the bottom of a tank car and the like. To effectively deal with such accumulation, the present invention provides a sweeping action constituting a side-to-side action of nozzle 8 driven by rotor motor 1. The scope of this sweeping action is controlled by programming suitable adjustable distances which control the alternating forwarding and reversing rotation of nozzle 8. For example, it might be appropriate to "sweep" the nozzle 15 or 30 degrees relative to the vertical in order to force a typical heterogeneous fluid admixture out of the tank car.

It should be noted that, while the rotor motor is clearly required to turn the nozzle to accomplish a sweeping action by the present invention on a tank car floor in each of forward and reverse directions, the actuator motor is also useful for effectively actuating the nozzle throughout the length of the floor. It should be understood, however, that while rotor motor 1 is required to cause side-to-side sweeping action, i.e., the rotor motor is required to turn in both directions, actuator motor 12 is only required to cause actuation in one direction and only at every other stroke of the rotor motor.

For example, as the rotor motor causes the nozzle to sweep left and then right, the actuator motor causes the nozzle to turn either left or right, thereby defining the direction of actuation of the nozzle. Thus, for performing the sweeping action taught by the present invention, after being situated at the longitudinal center in a typical tank car—directly below the manway—(see FIG. 1) to sweep and actuate upwards towards end-cap 200A, the following sequence preferably occurs: rotor motor 1 turns nozzle 8 left and right, while actuator motor 12 causes actuation of the nozzle left and then pauses. As hereinbefore described in detail, pausing the actuator motor, stops idler gear 17, thereby providing a track to turn enmeshed actuator gear 4. To cause the nozzle to return to its starting point, the sequence is simply reversed: the rotor motor again turns the nozzle left and right, but now the actuator motor first pauses the nozzle and then turning it to the right.

Those skilled in the art will appreciate the synergy between the combination of the rotor motor and the actuation motor taught by the present invention. It should also be evident that the sweeping action contemplated by the present invention is similar to its orbital washing action. As hereinbefore described in detail, during the novel orbital action enabled by the present invention, each of these two motors commences rotating at the same speed, but at every revolution thereof the actuator motor is instantaneously paused before resuming its preset rotational speed. This, of course, causes actuation depending from the duration of the pause. Similarly, during sweep action, actuation depends from the duration of pausing the actuator motor. On the other hand, since the sweep taught by the present invention is bidirectional, this pause must occur during the left swing of the sweep to actuate the nozzle upwards and occur during the right swing of the sweep to actuate downwards. Thus, this actuation action is akin to the action of a conventional ratchet.

It will be appreciated by those skilled in the art that if both the rotor motor and the actuator motor were performing identically during the sweeping action with respect to each other, i.e., if both motors were alternately forwarding and reversing simultaneously, then no actuation would ever occur. But, by pausing the actuator motor during the orbital action, actuation may be accomplished on an incremental basis.

As will be appreciated by practitioners in the art, to effectively wash all of the interior surfaces of typically cylindrically-shaped tank car 200 (FIG. 1) including its end caps and bulkhead, the present invention teaches an apparatus capable of delivering a single, powerful and controlled thrust of fluid F applied upon a plurality of interior tank car surfaces 220 through nozzle 13. Depending upon the residue being washed from interior surfaces 220, fluid F may be water, diesel fuel, Terpine hydrocarbon, caustic soda, etc. As is common in the art, as clearly shown in FIGS. 2–3, fluid F flows through a plurality of preferably elliptical slots configured in fluid channel 11 within rinser apparatus 100.

Under the teachings of the present invention, to initiate cleaning of tank car 200, after apparatus 100 is inserted through manway 205 and secured thereto using lockdown assembly 60, air to drive motors 1 and 12 is turned on externally of the tank car and then a sweeping action up to the center of the bulkhead occurs. With the preferred embodiment, this typically takes only about one minute. Next, a "tripping action" occurs wherein nozzle 8 rotates through 360 degrees and actuates back to its beginning position; this progression typically takes about 6–12 minutes. Depending upon the specific cleaning and rinsing requirements of the tank car, this cycle may be repeated by bypassing a final stop sensor and the like. Otherwise, the apparatus is oriented to treat the opposite end of the tank car (as shown by the dotted lines in FIG. 1). This is accomplished by unlocking lug 61 from hinge 69 situated at the top, center of lockdown assembly 60 and rotating through 180 degrees and then re-securing lug 61 to hinge 69. It should be understood that the present invention may be manually operated to perform such a sweep cycle once or multiple times as appropriate.

Figure 3:
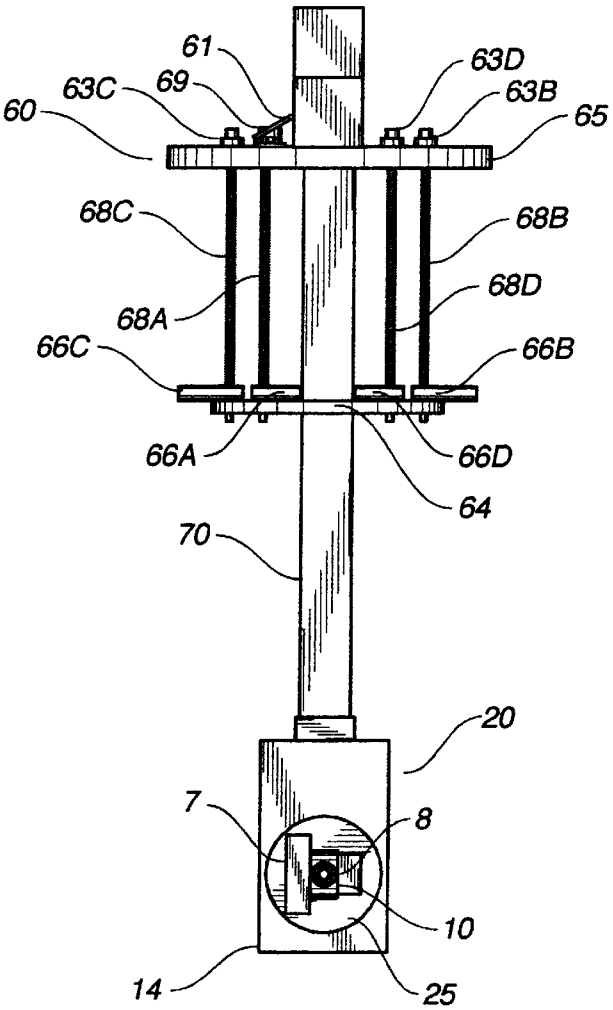
FIG. 3 depicts a right side view of the embodiment depicted in FIG. 2.
Figure 2:
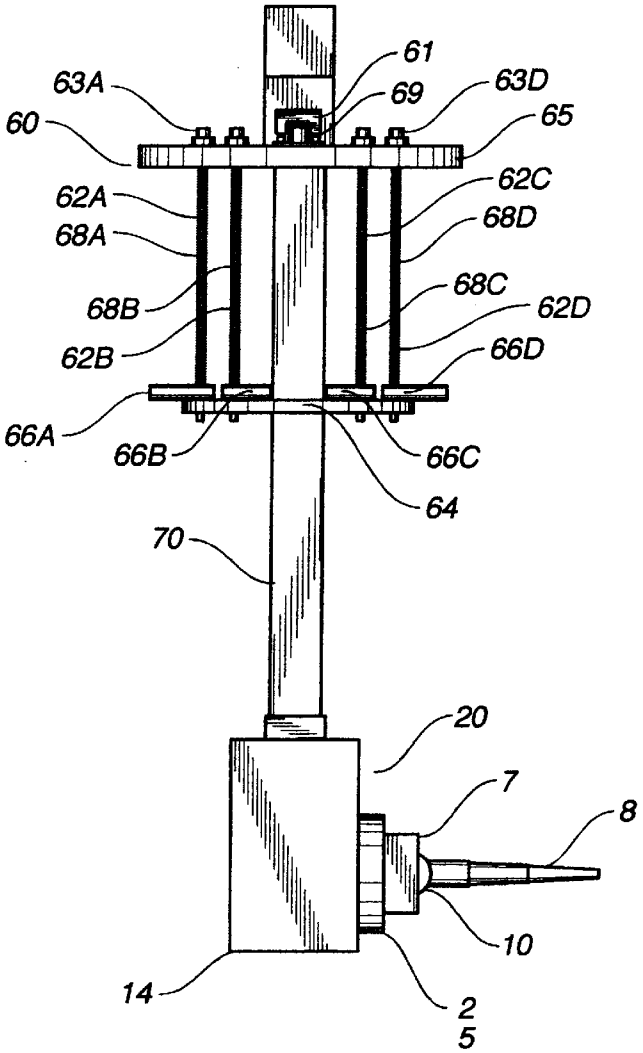
FIG. 2 depicts a front view of the preferred embodiment depicted in FIG. 1.
Figure 4:
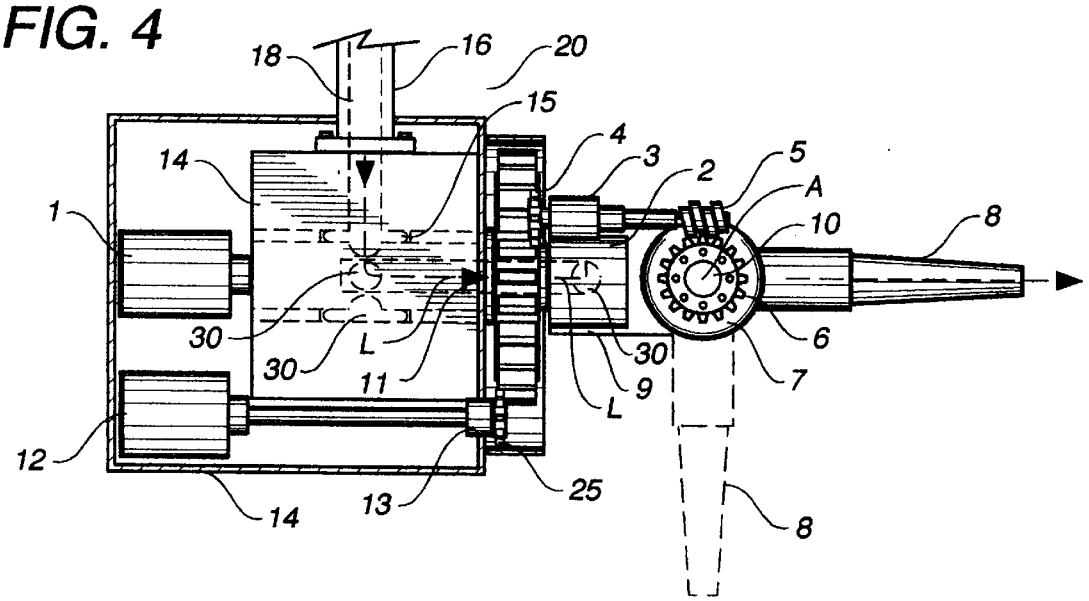
FIG. 4 depicts a partial cut-away front view of a portion of the embodiment depicted in FIGS. 2–3.
Figure 5:
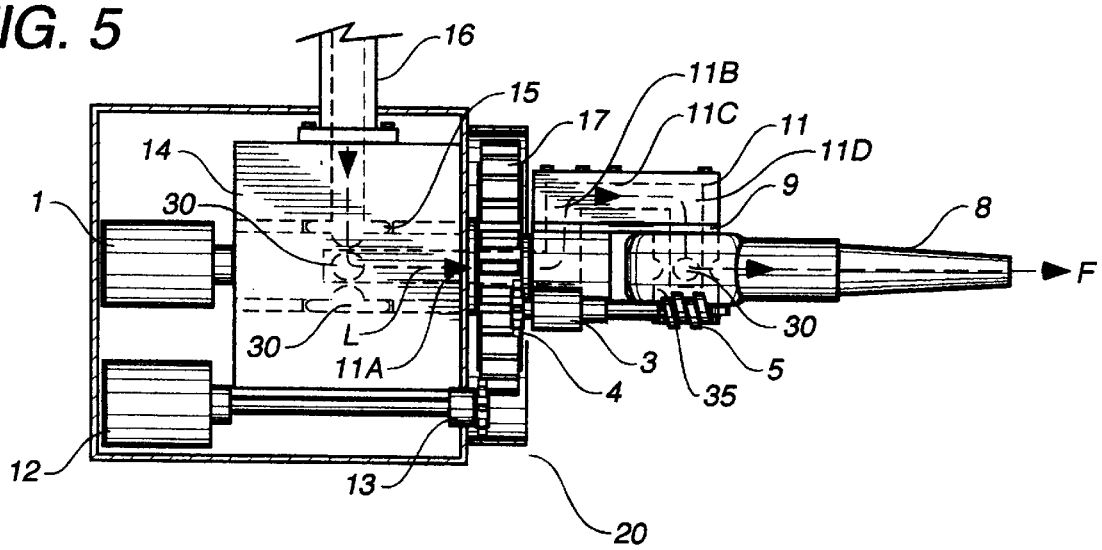
FIG. 5 depicts a partial cut-away top view of the embodiment depicted in FIG. 4.
Figure 6:
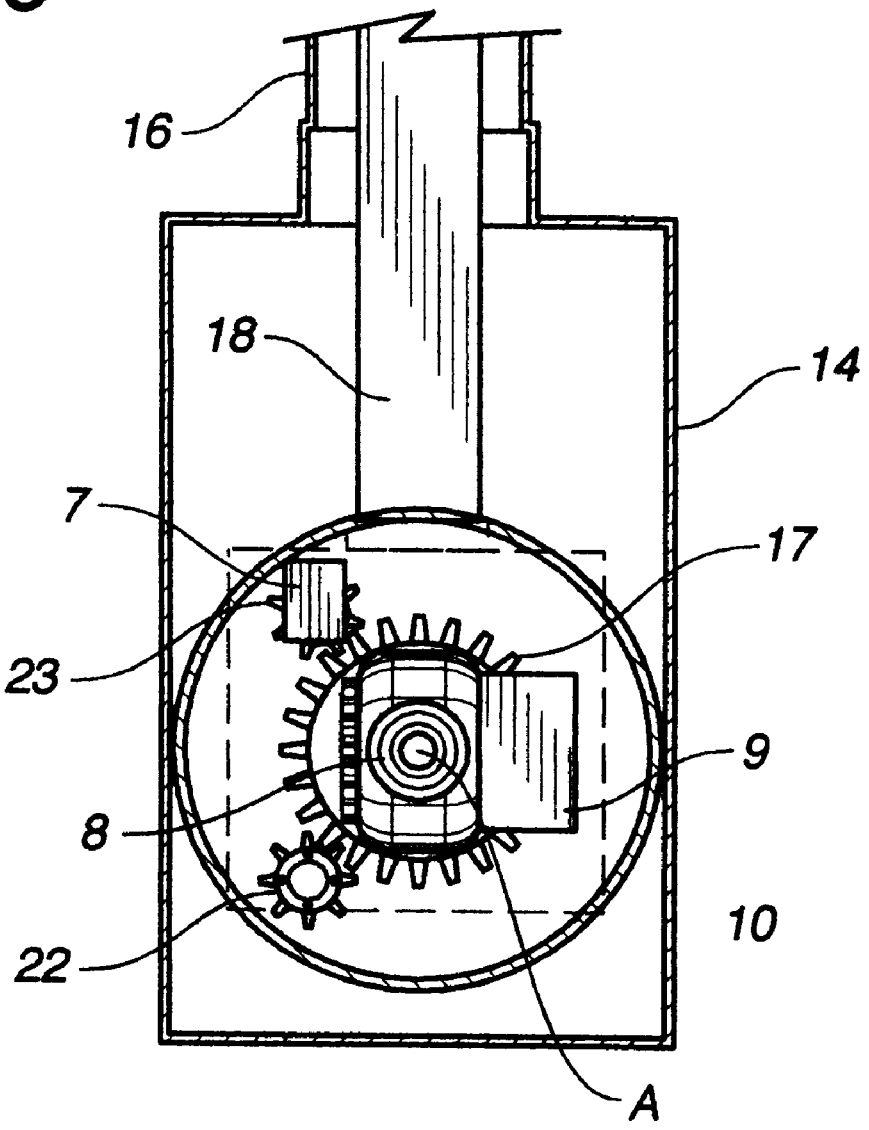
FIG. 6 depicts a right side view of the embodiment depicted in FIGS. 4–5.

As will now be described in detail, the preferred embodiment of the present invention is secured to a conventional manway by lockdown assembly 60. More particularly, as depicted in FIGS. 1–3, the present invention is preferably constructed with four independent lockdown members 62 A, B, C, D which are configured to be snugly received beneath manway lip 210, and secured thereto with lug 61 attached to hinge 69. Using an impact wrench and the like which is received by cleat 63A, B, C, D, each lockdown member 62 A, B, C, D, respectively, is individually loosened or tightened relative to manway lip 210. Focusing upon lockdown member 62A, it is seen having cleat 63A, transversal rod 68A and dog member 66A. Dog member 66A is preferably threadedly attached to transversal rod 68A which is attached at each end thereof to lip ring 65 and support ring 64, respectively. It will be understood that attaching plurality of transversal rods 68A, B, C, D of plurality of lockdown members 62 A, B, C, D to supporting ring 64 imparts stability to lockdown assembly 60.

Since tank car manways are typically uneven, the present invention provides a convenient and secure means of accommodating manways of various sizes and surface textures and configurations. By appropriately tightening each individual rod 68A, B, C and D, corresponding lockdown member 62A, B, C, D, respectively, becomes affixed adjacent manway lip 210 at lip ring 65. As will be appreciated by those skilled in the art, stability ring 64 is configured with a plurality of limit stop pairs to limit positioning members 66A, B, C, D, respectively, wherein each such positioning member is oriented in one of two positions 180° relative to each other. This plurality of limit stop pairs thus comprises a corresponding plurality of first limit stops which limit the positioning of each of members 66A, B, C, D, respectively, and a plurality of second limit stops which limit the positioning of each of members 66A, B, C, D, respectively, 180° relative to the positioning of the corresponding first limit limits.

Accordingly, when plurality of positioning members 66A, B, C, D are positioned adjacent the plurality of first limit stops and thereby positioned parallel to supporting ring 64, plurality of lockdown members 62 A, B, C, D cease contact with adjacent surfaces of the tank car manway lip. Thus, lockdowns 62 A, B, C, D effectively cam out of the way, i.e., are arranged into a smaller diameter so that removal through manway 205 may be easily accomplished. On the other hand, when plurality of positioning members 66A, B, C, D are positioned adjacent the plurality of second limit stops and thereby perpendicular to supporting ring 64, plurality of lockdown members 62 A, B, C, D establish contact with adjacent surfaces of the manway lip. As will be understood by those skilled in the art, plurality of positioning members 66A, B, C, D cam into a larger diameter so that the respective outer edges thereof snugly contact respective surfaces of interior wall 220 proximal to manway lip 210; in so doing, of course, the present invention is enabled to remain locked in place under the high pressure fluid thrust delivered through nozzle 8 as hereinbefore described.

As contemplated by the present invention, when the sweep cycling hereinbefore described is completed for half of a tank car and the like, central portion of lockdown assembly 60 is unlocked by pivoting lug 61 in hinge 69, without loosening lockdowns 62 A, B, C, D, and apparatus 100 is rotated through 180°. The present invention is then re-secured by locking lug 61 in hinge 69.

Figure 7:
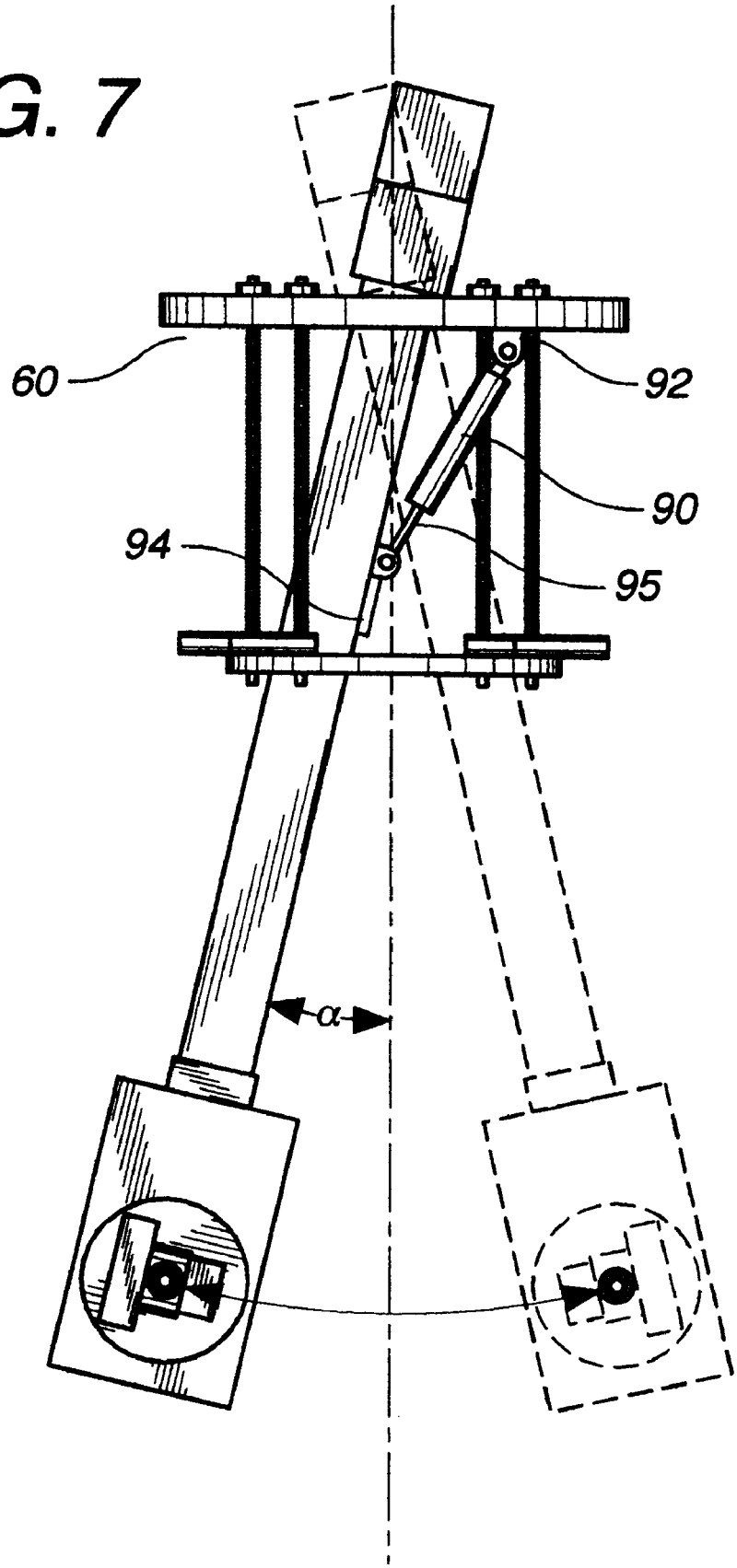
FIG. 7 depicts a front view of the preferred embodiment depicted in FIGS. 1–6, depicting changing orientation thereof from one end of the tank car depicted in FIG. 1 to the other opposite end of the tank car.
Figure 9:
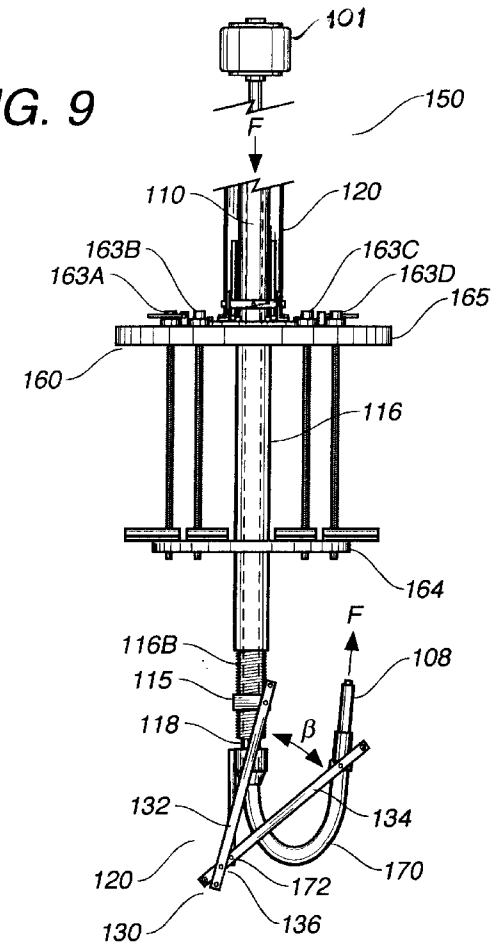
FIG. 9 depicts a front view of a portion of the preferred embodiment depicted in FIG. 8, shown in a contracted configuration.
Figure 8:
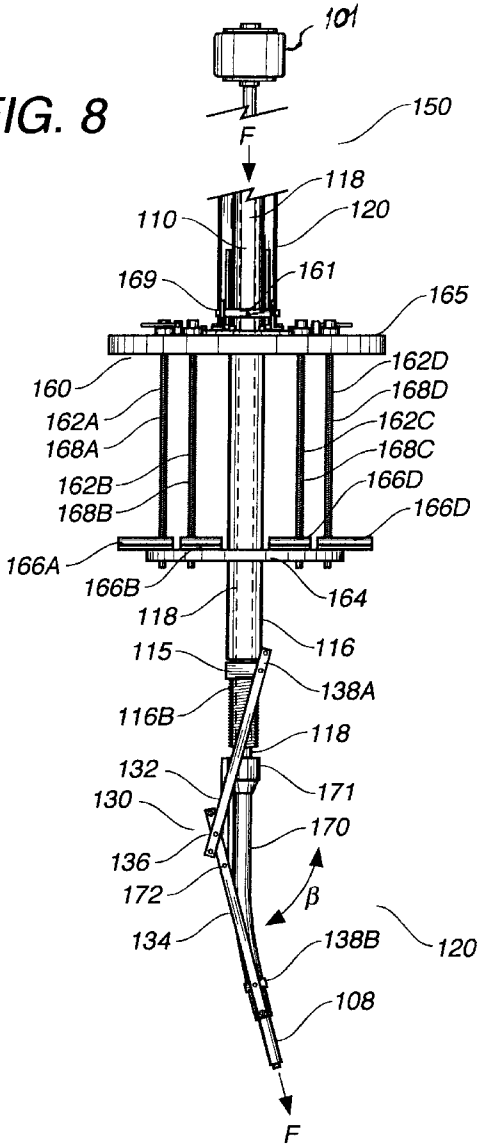
FIG. 8 depicts a front view of an alternative preferred embodiment of the present invention, shown in an extended configuration.

Now referring to FIG. 7, there is depicted an alternate embodiment of the present invention which enables the single spray of high pressure fluid to effectively blast around standpipes and other obstacles normally encountered within a tank car and the like. By providing an embodiment having a pneumatically-controlled piston 90 and cylinder 95 as shown, the orientation of frame 70 may be angled through $\alpha°$ with respect to the vertical, and consequently the spray emanating from the nozzle may be correspondingly altered to avoid a diversity of obstacles present in a tank car and the like. Thus, the incidence of such obstacles or "shadows" predictably present within tank cars and the like are routinely circumvented by the present invention. Accordingly, the present invention provides a thorough washing and rinsing of tank cars and the like heretofore unknown in the art Referring now to FIGS. 8 and 9, there is depicted another alternative embodiment of the present invention. As will be evident to those skilled in the art, FIG. 8 shows preferred embodiment of the present invention 150 in an extended configuration, while FIG. 9 shows this embodiment in a contracted configuration. A particular advantage of this embodiment is its simplified design and streamlined construction. As will be hereinafter described, high-pressure, concentrated fluid stream F communicates with nozzle 108 from an external fluid source (not shown) through conduit means 118 contained within hollow support column 116 and through swivel assembly 120. Contained in the annular space between support column 116 and conduit means 118 is swivel body member 110 which synchronously swivels collar means 171 to which is attached flexible hose means 170. Support column 116 is preferably screwably affixed to ring platform means or lip ring means 165. Platform means 165 is configured to be securably attached to the lip of a manway opening of a railway tank car as hereinbefore described in detail.

Thus, depicted therein is lockdown assembly 160 which functions as hereinbefore described relative to FIGS. 2 and 3. In particular, there are shown plurality of lockdown members 162A, B, C, D comprising plurality of independent transversal rods 168A, B, C, D and corresponding plurality of cleat members 163A, B, C, D and corresponding plurality of positioning members 166A, B, C, D. In combination, this plurality of positioning members and cleat members is able to conveniently suitably position each of the plurality of independent transversal rods to be securably attached to a manway lip regardless of asperities and any other surface aberration typically encountered in railway tank cars.

Figure 10:
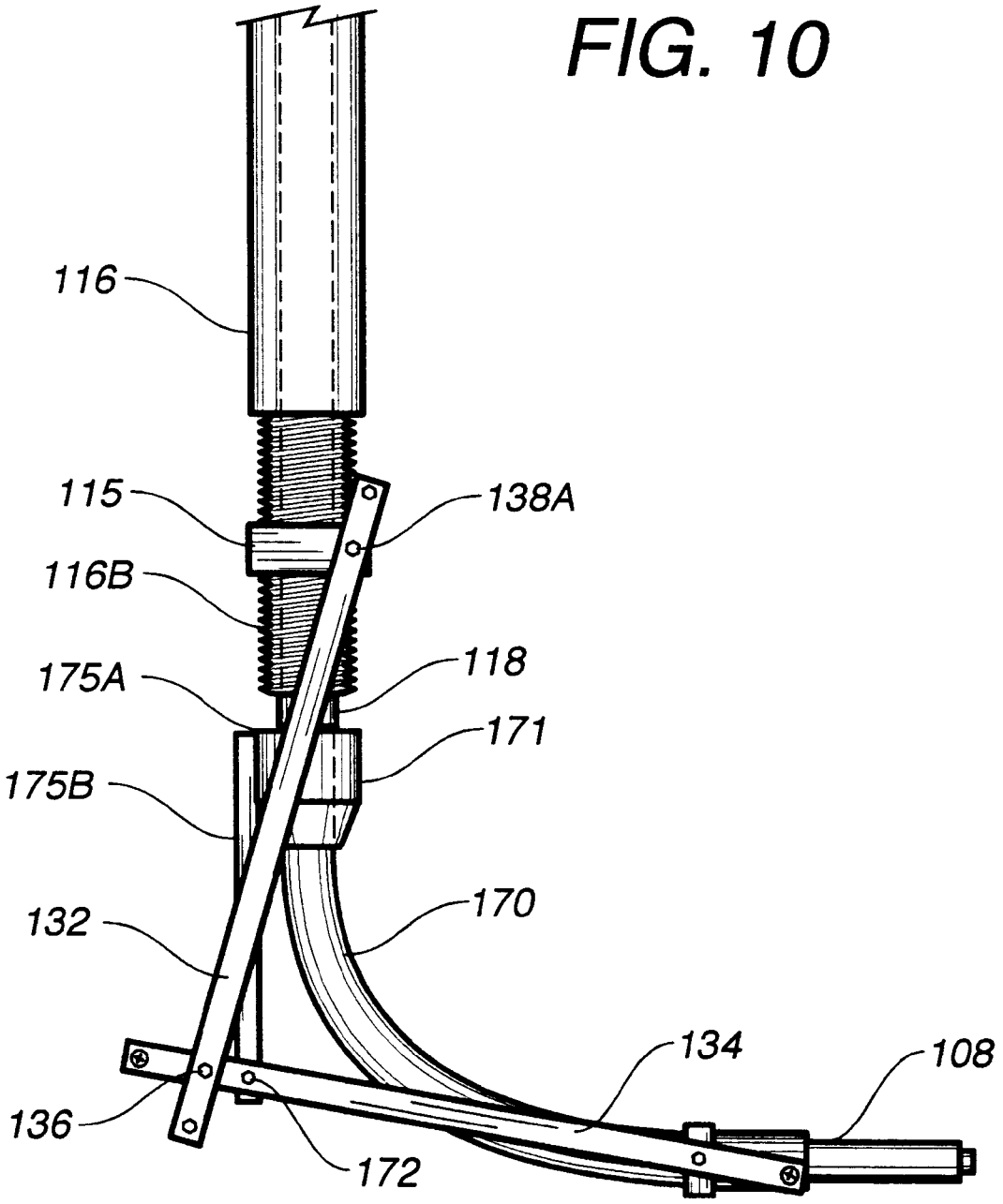
FIG. 10 depicts an isolated front view of a portion of the preferred embodiment depicted in FIGS. 8 and 9.

Still referring to FIGS. 8 and 9, swivel assembly 120, which receives rinsing fluid F through conduit means 118, comprises swivel body member 110, linkage means 130, preferably swiveling nut means 115 and corresponding actuator body means 116B flexible hose means 170, and nozzle means 108. Now referring also to FIG. 10 depicting an isolated front view of the linkage means under the present invention, linkage assembly 130 comprises upper linkage arm 132 which is pivotally connected to lower linkage arm 134 at point 136. Upper linkage arm 132 is fixedly attached at its remote end 138A to swivel nut means 115; similarly, lower linkage arm 134 is fixedly attached at its remote end 138B to flexible hose means 170. Under the influence of internally-threaded actuator nut means 115 swiveling about correspondingly externally-threaded actuator body means 116B linkage means 130 pivots about pivot leverage point 172. As clearly shown in FIG. 10, collar means 170 comprises collar 175A for securably attaching hose means 170 to conduit means 118, and fixedly attached backbone support means 175B which provides a rigid structure on the linkage side to support linkage leverage point 172.

Referring now to FIGS. 8 and 9, as will be understood by those skilled in the art, as the actuator pair comprising the combination of internally-threaded actuator nut means 115 rotating about externally-threaded actuator body means 116B, thereby causing linkage means 130 to pivot relative to pivot point 172, angle β between upper linkage arm 132 and lower linkage arm 134 of swivel linkage means 130 varies substantially through 180°. When angle β is 180° then hose means 170 is disposed in a linear configuration wherein nozzle means 108 is disposed in axial or longitudinal alignment with support means 116. It should be understood that under the present invention all swivel components synchronously are actuated and swivel relative to stationery support column means 116. Thus, this actuation is modeled after a nut being turned about a stationary threaded bolt The (internally) threaded nut, of course, constitutes the female aspect of the actuation, and the (externally) threaded column constitutes the corresponding male aspect of the actuation. It should be evident that, when nozzle means 108 is situated in the extended configuration depicted in FIG. 8, that fluid F is sprayed in an orbital pattern aimed primarily toward the floor and lower wall portions of the tank car. On the other hand, when angle β is acute, varying from 90° toward 0°, then nozzle means 108 is situated in the contracted configuration depicted in FIG. 9, wherein fluid F is sprayed in an orbital pattern aimed primarily toward the ceiling and upper wall portions of the tank car.

Hence, through the leveraging action of swivel linkage assembly 130, wherein stationary actuator body means 116B is preferably threadedly attached to nut means 115, pair of pivotally interconnected swivel arms 123 and 134 cause flexible hose 170 to articulate and bend slowly as angle β gradually decreases from 180° through 90° toward 0°, thereby directing nozzle means 108 along different orbital paths of cleaning and rinsing of the tank car interior walls, floor, and ceiling. It will be appreciated by those skilled in the art that the synchronous swiveling action taught by this embodiment of the present invention is driven by suitable motor means. In particular, when such motor means is turning in one direction, it actuates the bending of hose means 170 which is controlled as a function of the range of motor speed selected and then by reversing the motor at the end of the cycle. According to the present invention, a cycle consists of swivel fastener means 115 traveling longitudinally downwards along the length of the threaded column support means 116 thereby effectuating maximum articulation and concomitant bending of hose 108 into the U-shape configuration clearly shown in FIG. 9. Reversing this cycle reverses the path of the nut means 115 as it travels longitudinally upwards along the length of the threaded actuator body means 116B thereby effectuating minimum articulation and straight alignment of hose 108 into its beginning configuration clearly shown in FIG. 8.

Hence, it will be appreciated by those skilled in the art that the embodiment shown in FIGS. 8 and 9 accomplishes the purposes of the present invention with the benefit of a streamlined structure and with only a minimum of parts. It is an advantage and feature of this embodiment that it is capable of delivering a full 360° orbital wash without having to manually reorient its position on the floor of a tank car and the like.

Other variations and modifications will, of course, become apparent from a consideration of the structures and techniques hereinbefore described and depicted. Accordingly, it should be clearly understood that the present invention is not intended to be limited by the particular features and structures hereinbefore described and depicted in the accompanying drawings, but that the concept of the present invention is to measured by the scope of the appended claims herein.

What is claimed is:

1. In a tank car having a plurality of interior surfaces including a floor, side walls, end walls and a ceiling having a manway for access of a worker thereinto, and having a reversing rotor motor disposed externally thereof, a rinsing apparatus comprising:

a lockdown assembly configured to be releasably and snugly secured to said manway;

hollow support column means having a longitudinal axis and fixedly attached to said lockdown assembly at one end thereof, and enclosing a fluid conduit means for delivering high-pressure fluid from an external reservoir to a swivel assembly disposed axially of said hollow support columm means;

said swivel assembly configured to be insertable through said manway and having a swivel body member disposed axially of said longitudinal axis and rotatably interconnected with said rotor motor at one end thereof and interconnected with a linkage assembly of said swivel assembly at its other opposite end;

said swivel body member disposed annularly between said hollow support column means and said fluid conduit means;

said linkage assembly having flexible hose means fixedly attached thereto, and having nozzle means fixedly attached to said flexible hose means at a remote end thereof for receiving said high-pressure fluid from said fluid conduit means and then forming a spray pattern of said high-pressure fluid upon said plurality of interior surfaces of said tank car; and actuation means rotatably attached to said swivel body member for controlling articulation and bending of said flexible hose means about an actuation axis disposed axially of said longitudinal axis.

2. The rinsing apparatus recited in claim 1, wherein said actuation means comprises an internally-threaded nut means pivotally attached to said linkage assembly and configured to rotatably engage corresponding external threads affixed to said swivel body member.

3. The rinsing apparatus recited in claim 2, wherein said linkage assembly comprises a first linkage arm fixedly attached to said actuation means and a second linkage arm pivotally attached to said first linkage arm at one end and fixedly attached to said nozzle means at its other opposite end.

4. The rinsing apparatus recited in claim 3, wherein said linkage assembly further comprises a pivot point means where said second linkage arm is pivotally attached to a backbone support means of said swivel nut means for articulating and bending said hose means responsive to said actuation means.

5. The rinsing apparatus recited in claim 1, wherein said lockdown assembly comprises:

a lip ring configured to be snugly received by a lip surface of said manway;

a plurality of independent lockdown members screwably attached at one end thereof to said lip ring and screwably attached at another opposite end thereof to a support ring; and securing means disposed centrally of said lip ring and hingedly attached to a lug means for securing said lip ring to said lip surface of said manway.

6. The rinsing apparatus recited in claim 5, wherein each of said plurality of lockdown members comprises:

cleat means disposed atop said lip ring and affixed to an end of a transversal rod interposed between said lip ring and said support ring, said cleat means configured for rotating said transversal rod; and positioning means disposed atop said support ring and affixed to an end of said transversal rod opposite said end affixed to said cleat means for biasing said lip ring against said lip surface when said positioning means is in a first position and for biasing said lip ring away from said lip surface when said positioning means is in a second position.

7. In a tank car having a plurality of interior surfaces including a floor, side walls, end walls and a ceiling having a manway for access of a worker thereinto, and having a reversing rotor motor disposed externally thereof, a rinsing apparatus comprising:

a lockdown assembly configured to be releasably and snugly secured to said manway;

hollow support columm means having a longitudinal axis and fixedly attached to said lockdown assembly at one end thereof and enclosing a fluid conduit means for delivering high-pressure fluid from an external reservoir to a swivel assembly disposed axially of said hollow support columm means;

said swivel assembly configured to be insertable through said manway and having a swivel body member disposed axially of said longitudinal axis and rotatably interconnected with said rotor motor at one end thereof and interconnected with a linkage assembly at its other opposite end;

said linkage assembly having a first linkage arm fixedly attached to said actuation means and a second linkage arm pivotally attached to said first linkage arm at one end and fixedly attached to said nozzle means at its other opposite end;

said swivel body member disposed annularly between said hollow support column means and said fluid conduit means;

said linkage assembly having flexible hose means fixedly attached thereto, and having nozzle means fixedly attached to said flexible hose means at a remote end thereof for receiving said high-pressure fluid from said fluid conduit means and then forming a spray pattern of said high-pressure fluid upon said plurality of interior surfaces of said tank car; and actuation means rotatably attached to said swivel body member for controlling articulation and bending of said flexible hose means about an actuation axis disposed axially of said longitudinal axis.

8. The rinsing apparatus recited in claim 7, wherein said actuation means comprises an internally-threaded nut means pivotally attached to said linkage assembly and configured to rotatably engage corresponding external threads affixed to said swivel body member.

9. The rinsing apparatus recited in claim 8, wherein said linkage assembly further comprises a pivot point means where said second linkage arm is pivotally attached to a backbone support means of said swivel nut means for articulating and bending said hose means responsive to said actuation means.

10. The rinsing apparatus recited in claim 9, wherein said lockdown assembly comprises:

a lip ring configured to be snugly received by a lip surface of said manway;

a plurality of independent lockdown members screwably attached at one end thereof to said lip ring and screwably attached at another opposite end thereof to a support ring; and securing means disposed centrally of said lip ring and hingedly attached to a lug means for securing said lip ring to said lip surface of said manway.

11. The rinsing apparatus recited in claim 10, wherein each of said plurality of lockdown members comprises:

cleat means disposed atop said lip ring and affixed to an end of a transversal rod interposed between said lip ring and said support ring, said cleat means configured for rotating said transversal rod; and positioning means disposed atop said support ring and affixed to an end of said transversal rod opposite said end affixed to said cleat means for biasing said lip ring against said lip surface when said positioning means is in a first position and for biasing said lip ring away from said lip surface when said positioning means is in a second position.

12. In a tank car having a plurality of interior surfaces including a floor, side walls, end walls and a ceiling having a manway for access of a worker thereinto, and having a reversing rotor motor disposed externally thereof, a rinsing apparatus comprising:

a lockdown assembly configured to be releasably and snugly secured to said manway;

hollow support column means having a longitudinal axis and fixedly attached to said lockdown assembly at one end thereof, and enclosing a fluid conduit means for delivering high-pressure fluid from an external reservoir to a swivel assembly disposed axially of said hollow support column means;

said swivel assembly configured to be insertable through said manway and having a swivel body member disposed axially of said longitudinal and rotatable interconnected with said rotor motor at one end thereof and interconnected with a linkage assembly at its other opposite end;

said linkage assembly having a first linkage arm fixedly attached to said actuation means and a second linkage arm pivotally attached to said first linkage arm at one end and fixedly attached to said nozzle means at its other opposite end;

said swivel body member disposed annularly between said hollow support column means and said fluid conduit means;

said linkage assembly having flexible hose means fixedly attached thereto, and having nozzle means fixedly attached to said flexible hose means at a remote end thereof for receiving said high-pressure fluid from said fluid conduit means and then forming a spray pattern of said high-pressure fluid upon said plurality of interior surfaces of said tank car;

actuation means including an internally-threaded nut means pivotally attached to said linkage assembly and configured to rotatably engage corresponding external threads affixed to said swivel body member for controlling articulation and bending of said flexible hose means about an actuation axis disposed axially of said longitudinal axis; and said linkage assembly further including a pivot point means where said second linkage arm is pivotally attached to a backbone support means of said swivel nut means for articulating and bending said hose means responsive to said actuation means.

13. The rinsing apparatus recited in claim 12, wherein said lockdown assembly comprises:

a lip ring configured to be snugly received by a lip surface of said manway;

a plurality of independent lockdown members screwably attached at one end thereof to said lip ring and screwably attached at another opposite end thereof to a support ring; and securing means disposed centrally of said lip ring and hingedly attached to a lug means for securing said lip ring to said lip surface of said manway.

14. The rinsing apparatus recited in claim 13, wherein each of said plurality of lockdown members comprises:

cleat means disposed atop said lip ring and affixed to an end of a transversal rod interposed between said lip ring and said support ring, said cleat means configured for rotating said transversal rod; and positioning means disposed atop said support ring and affixed to an end of said transversal rod opposite said end affixed to said cleat means for biasing said lip ring against said lip surface when said positioning means is in a first position and for biasing said lip ring away from said lip surface when said positioning means is in a second position.

* * * * *